US006736693B1

(12) United States Patent
Lund et al.

(10) Patent No.: US 6,736,693 B1
(45) Date of Patent: May 18, 2004

(54) ROLLING AND STANDING TOY DOLL

(75) Inventors: Bruce D. Lund, Chicago, IL (US); Krishnan Srirangam, Chicago, IL (US); Michael Starrick, Maywood, IL (US); Sunil Moothedath, Chicago, IL (US)

(73) Assignee: Lund and Company, Chicago, IL (US)

( * ) Notice: Subject to any disclaimer, the term of this patent is extended or adjusted under 35 U.S.C. 154(b) by 218 days.

(21) Appl. No.: 10/034,961

(22) Filed: Dec. 28, 2001

(51) Int. Cl.[7] ..... A63H 13/00

(52) U.S. Cl. ..... 446/354; 446/353; 446/377; 446/325

(58) Field of Search ..... 446/81, 175, 236, 446/297, 269, 298, 324, 330, 351–356, 358, 376, 377, 378, 383, 390, 484, 487; 180/8.6

(56) References Cited

U.S. PATENT DOCUMENTS 3,038,275 A * 6/1962 Curci ..... 446/293
3,500,577 A * 3/1970 Bart ..... 446/324
3,583,098 A * 6/1971 Bear et al. ..... 446/355
4,073,088 A * 2/1978 Beny et al. ..... 446/354
4,355,482 A * 10/1982 Sapkus et al. ..... 446/279
4,563,163 A * 1/1986 Herbstler et al. ..... 446/354
5,290,185 A * 3/1994 Murakami

* cited by examiner

*Primary Examiner*—Derris H. Banks
*Assistant Examiner*—Bena Miller

(57) ABSTRACT

A doll that includes a pair legs pivotally attached to a torso. The torso having a front side and backside. A pair of motor mechanisms separately attached to each leg for pivoting the legs forwards and backwards in accordance to a set of pre-programmed positions that moves the doll from a first orientation to a second orientation. The movement may be defined as rolling the doll from its front side to its backside and vice versa, as well as moving the doll to a standing position and walking the doll while it is standing.

18 Claims, 7 Drawing Sheets

20
34
position 4th
10
14
12

ROLLING AND STANDING TOY DOLL

BACKGROUND OF THE INVENTION

Dolls have always been the mainstay as a toy for young children. There have been numerous varieties of dolls from no interaction to fully interactive dolls. There exist dolls that speak, cry, sing and laugh in response to a child touching or squeezing various parts of the doll, as well as dolls that walk and crawl. However, there is always a continual need for improvements and new and novel features.

SUMMARY OF THE INVENTION

There is herein described and illustrated a unique animated doll that is hinged at the legs. The hinged legs permit the doll to repeatedly roll over from its back onto its tummy and then onto its back again. The doll can also stand up when it is lying on its tummy and once on its feet the doll can walk around. The doll achieves a fine balance and accurate movement through a pair of swipe switches that detect the position of the legs in relation to the body. There are two swipe switches, one for each leg. A microprocessor is able to determine the position of the legs at any time by reading the swipe switches. The doll also includes a ball switch with three positions that allow the microprocessor to determine whether the doll is laying on its back, on its tummy or standing up. An additional switch in one of the feet ensures that the doll is standing up and a switch in the tummy is used to initiate her rolling action.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DESCRIPTION OF THE DRAWINGS

Figure 2:
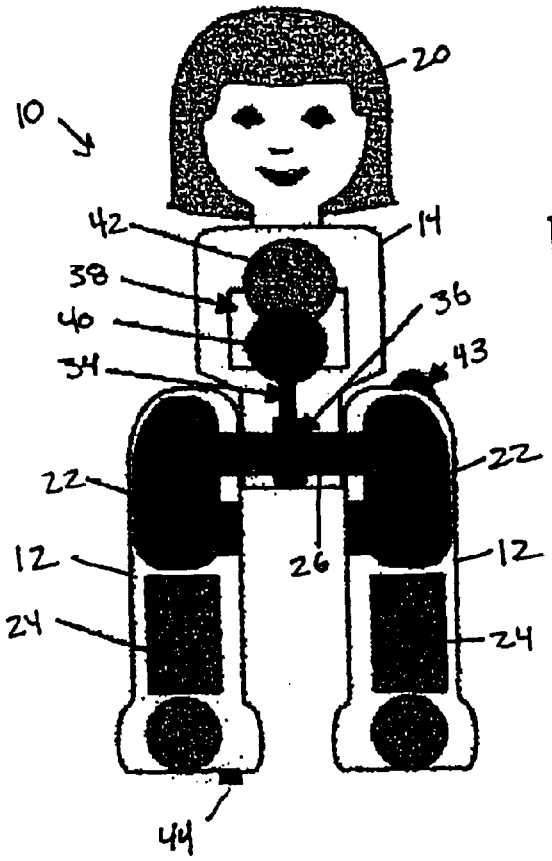
FIG. 2 is a front view of the doll illustrating the various mechanical components.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 1:
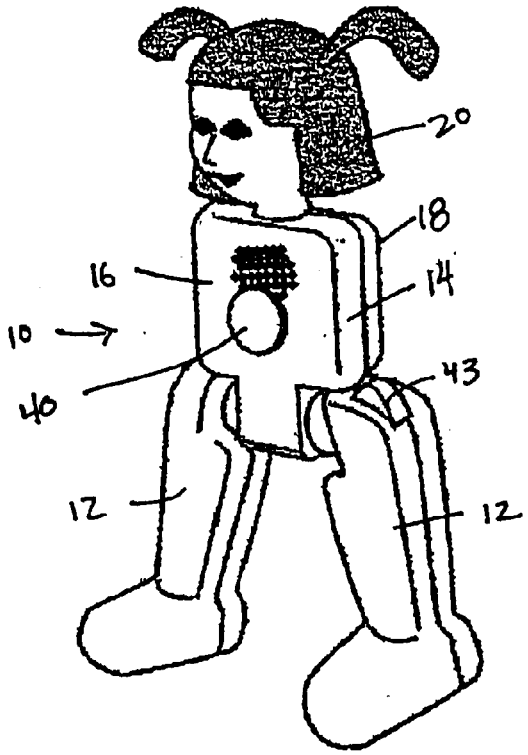
FIG. 1 is a perspective view of a the doll in a standing position.

Referring first to FIG. 1 there is illustrated generally a roll over doll 10 having a pair of legs 12 pivotally attached to a body 14 of the doll 10. The body 14 of the doll includes a front side 16 or tummy and a backside 18. A head 20 is also attached to the uppermost section of the body 14. The features of the doll 10 while illustrated as a girl may be changed without affecting the scope of this invention.

Figure 3:
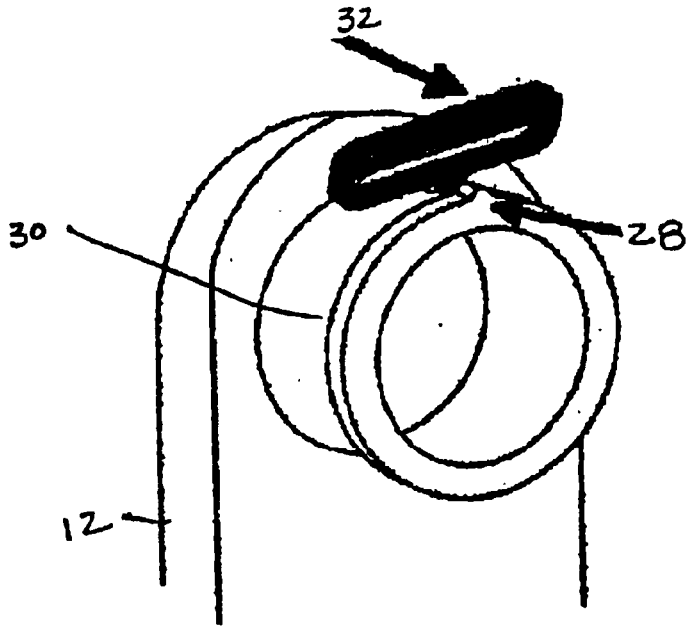
FIG. 3 is a perspective view of one of the legs showing the detent defined in the rim and the lock mechanism that is attached to the body of the doll to prevent too much movement in any single direction.

In FIG. 2 most of the internal mechanics of the roll over doll 10 are illustrated. As illustrated, each leg 12 includes a motor mechanism 22, both of which are in communication with a separate power source 24, such as a battery pack. As best shown in FIG. 2, each leg 12 is mounted on a center rod 26 that is attached to the lower section of the body 14. The motor mechanism 22 is also in communication with the center rod 26 such that each leg 12 may pivot about the swipe switch housing (not shown), causing the legs 12 to move forwards and backwards To prevent the legs 12 from pivoting too far in any direction when the doll 10 is walking, as shown in FIG. 3, the legs 12 includes detents 28 defined on rims 30, which project outwardly towards the body 14. The detents 28 come into contact with latch mechanisms 32 that are attached to the lower section of the body 14 (not shown).

Continuing to refer to FIG. 2, the doll 10 further includes a pair of swipe switches 34, one for each leg 12. Each swipe switch 34 has a corresponding swipe mechanism 36 such that when assembled the swipe mechanism 36 is in continuous contact with its corresponding swipe switch 34. The swipe switches 34 are also in communication with a circuit board 38. In addition, one of the legs 12 includes a foot switch 44, which is in communication with the circuit board 38, to indicate whether the doll 10 is standing up on a surface.

The body 14 of the doll 10 also includes a tummy switch 40. When the tummy switch 40 is activated the doll 10 may begin to roll or stand up, as discussed in greater detail below. The doll 14 may also include a speaker 42, which is used to emit various audio sounds in connection with the activation or movement of the doll 10. In addition the doll 10 may include a rollover bump 43. The rollover bump 43 assists the doll to roll over by increasing the momentum of the roll once the doll has passed over the rollover bump 43.

Figure 4:
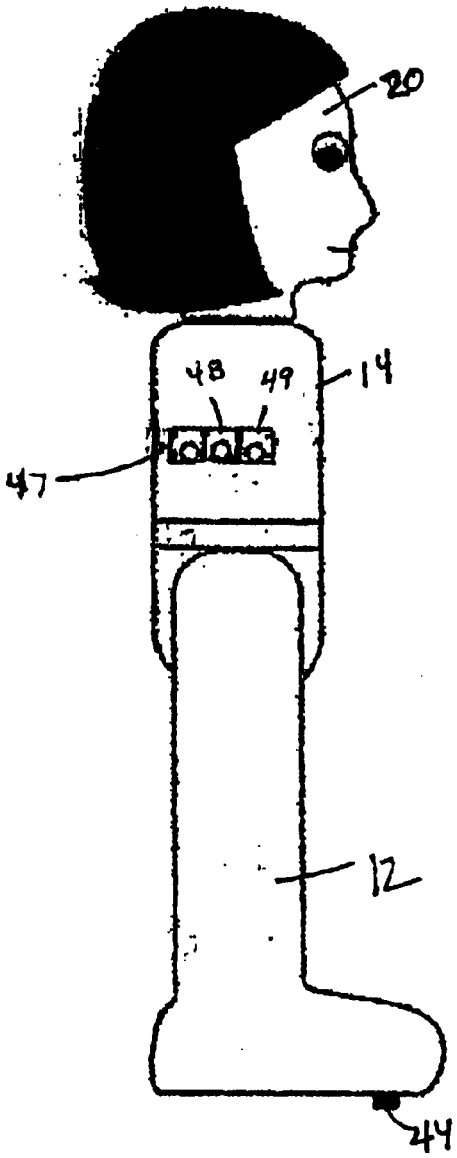
FIG. 4 is a side view of the doll illustrated with the ball switch.
Figure 5:
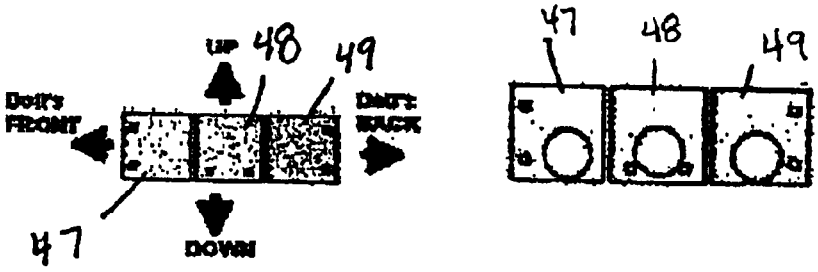
FIG. 5 illustrates the ball switch that indicate to a circuit board the orientation of the doll.

Referring now to FIGS. 4 and 5, the doll 10 may further include a ball switch with three positions, sequentially labeled 47, 48, and 49. The three positions act in concert with each other to determine the orientation of the doll 10, whether it is standing up or lying down on its backside 18 or on its tummy 16.

Figure 6:
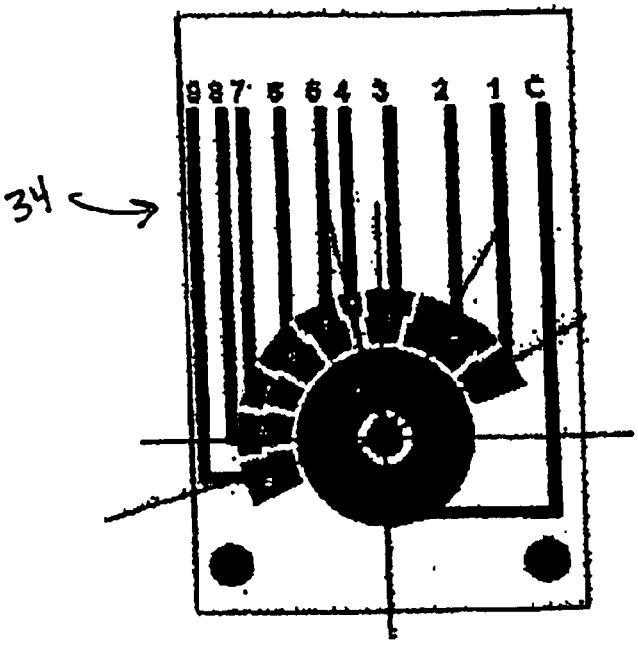
FIG. 6 is a front view of the swipe switch showing the various positions identified numerically.

In FIG. 6, one of the swipe switches 34 is illustrated; the other swipe switch would be similarly illustrated except being configured as a mirror representation in order to represent the movement from the other leg corresponding thereto. The movement of the corresponding leg 12 is represented on the swipe switch 34 by a plurality of positions further represented numerically as 1–9.

Figure 7:
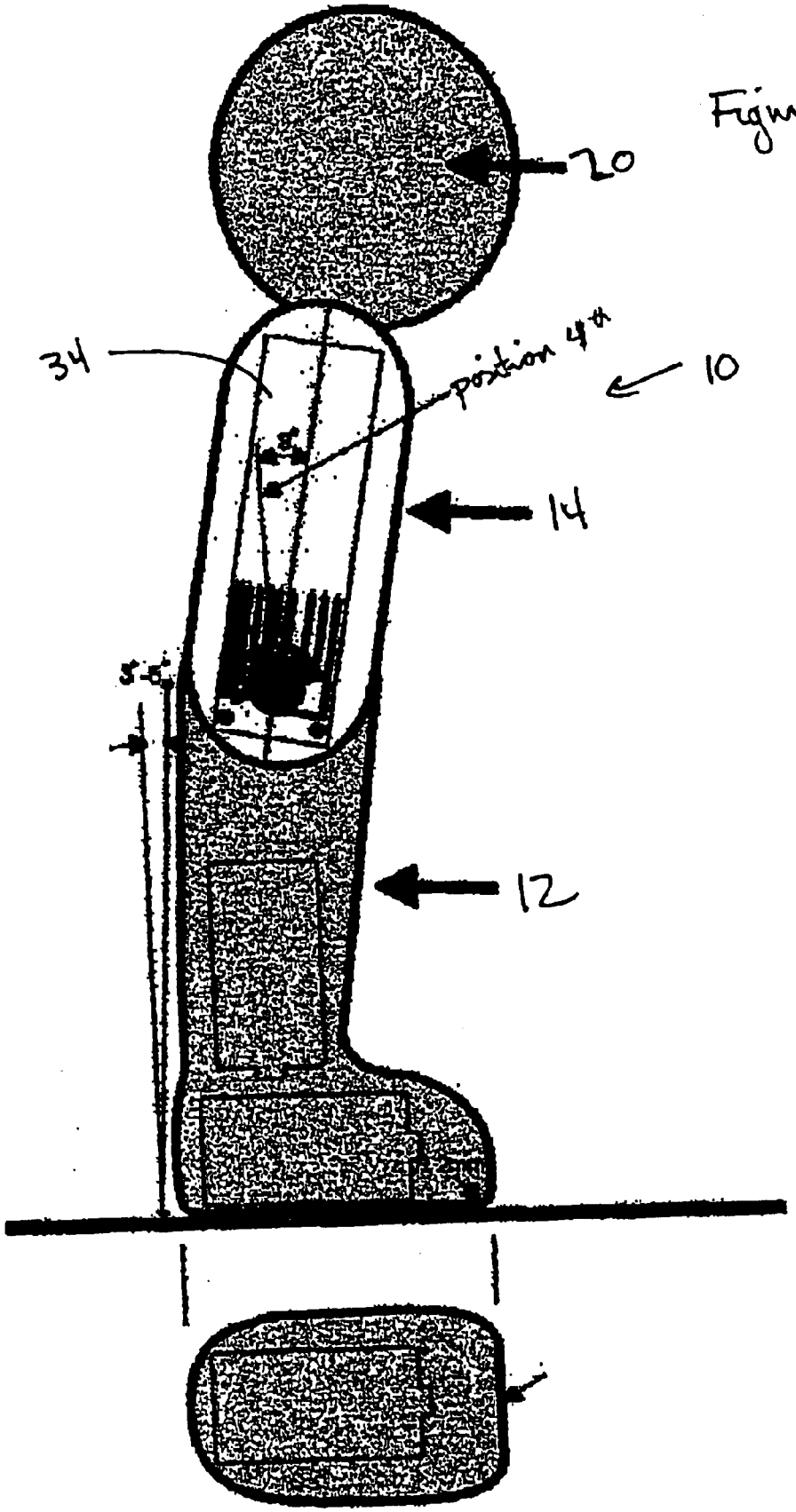
FIG. 7 is a side view of the doll standing and showing the position of the swipe switch in the $4^{th}$ position.

In FIG. 7, the doll 10 is shown standing upright with the legs 12 set to the $4^{th}$ position. In this position the doll 10 may walk and move around more easily without wobbling or falling down.

During operation, a user places the doll 10 in a first orientation, for example on its backside 18. The ball switch positions 47, 48, and 49 will indicate to the circuit board 38 this specific orientation. The circuit board 38 determining the first orientation of the doll 10 will then be capable of operating and controlling the motor mechanisms 22 to move the legs 12 in accordance to a set of pre-programmed positions, which moves the doll 10 from the first orientation to a second orientation. As such if the doll 10 is laying on its backside 18, the ball switch will indicate to the circuit board 38 that the doll is in this first orientation (on its backside 18). The circuit board 38 then can control the motor mechanisms 22 to move the doll 10 to roll onto its tummy 16. While the operation may be automatic, it is preferable that the user presses the tummy switch 40 to activate the doll 10.

Figure 8:
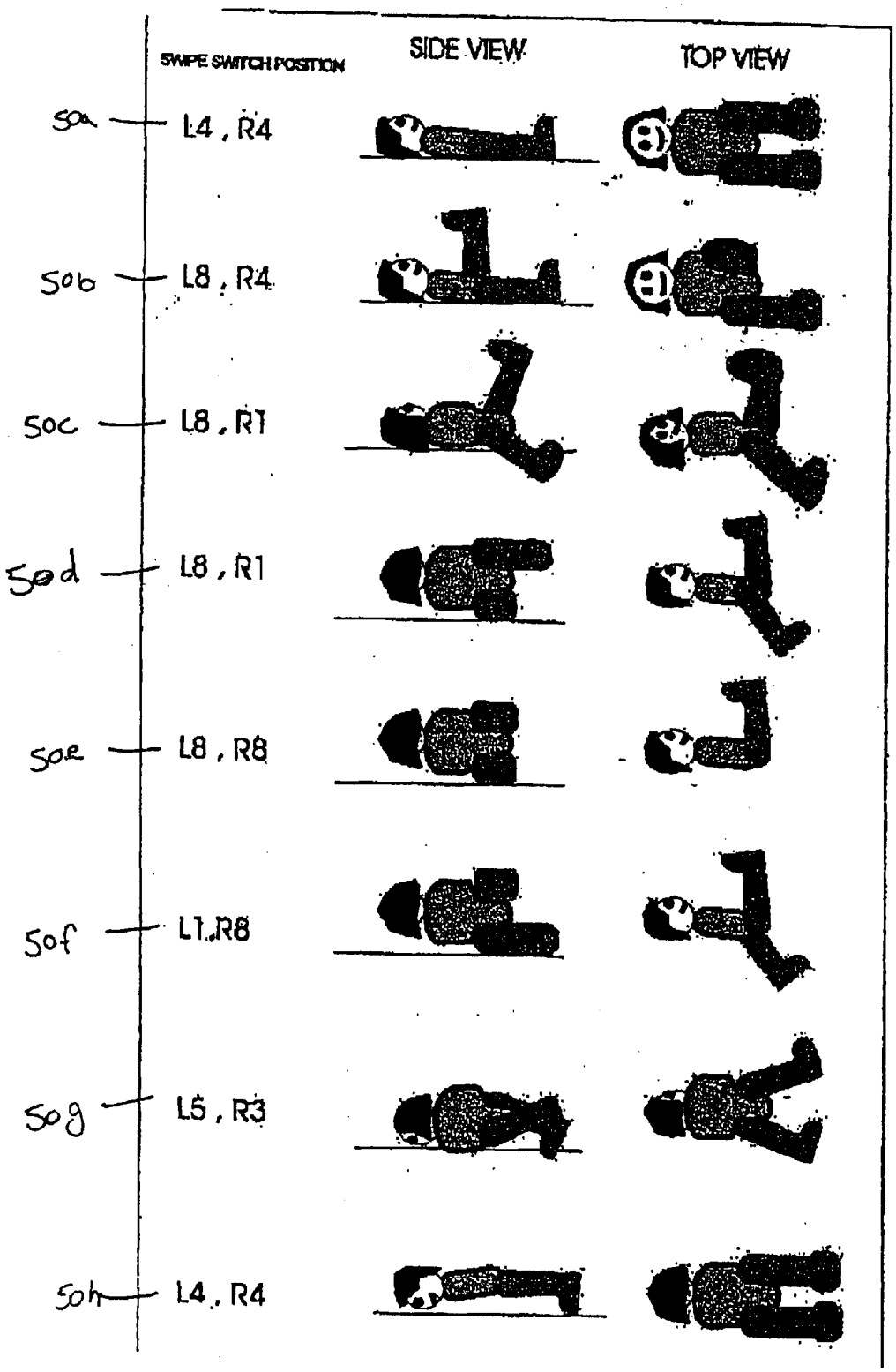
FIG. 8 illustrates the various swipe positions and illustrates the doll in the various positions when rolling from its backside to its tummy.
Figure 9:
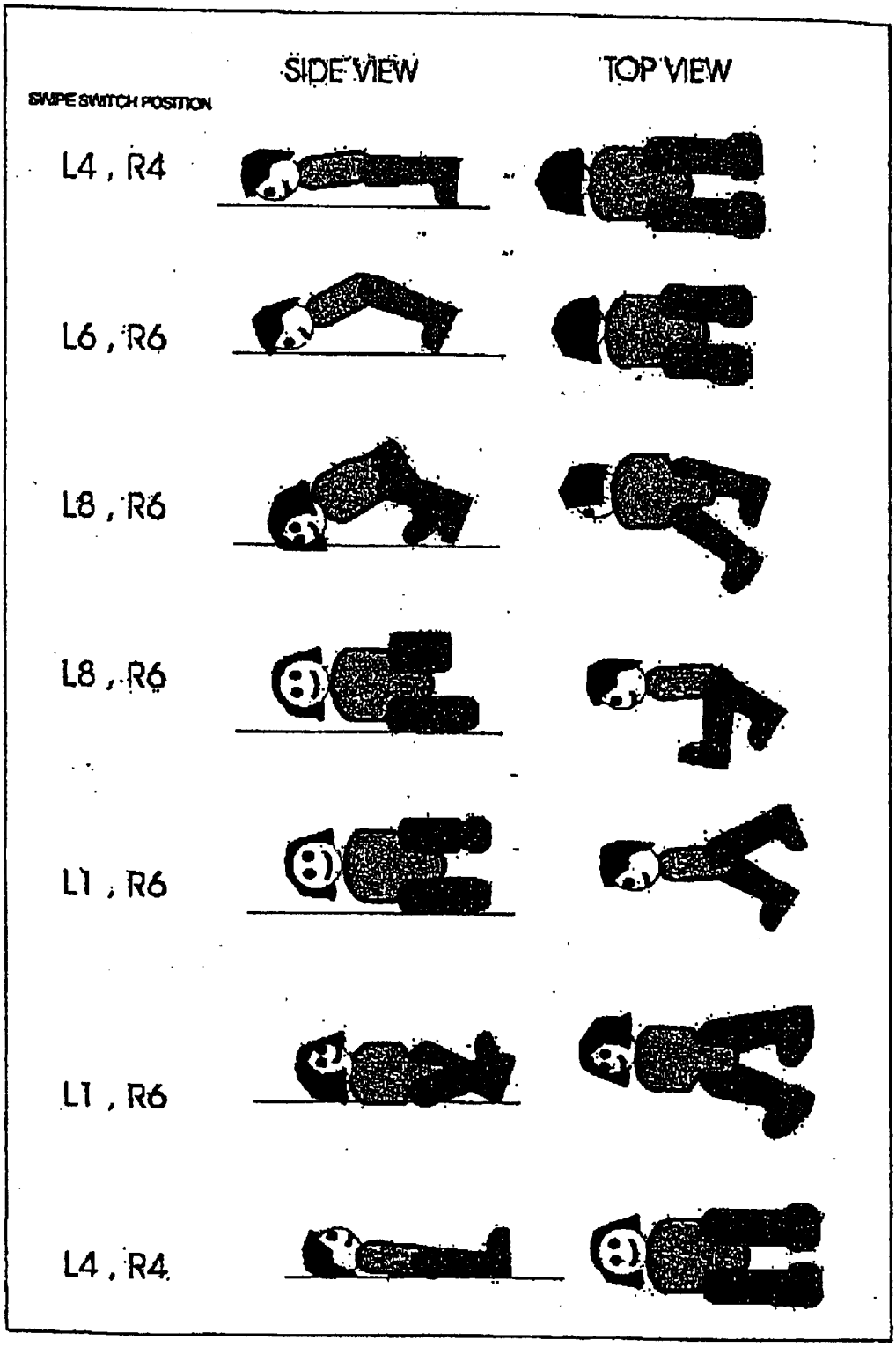
FIG. 9 illustrates the various swipe positions and illustrates the doll in the various positions when rolling from its tummy to its backside.
Figure 10:
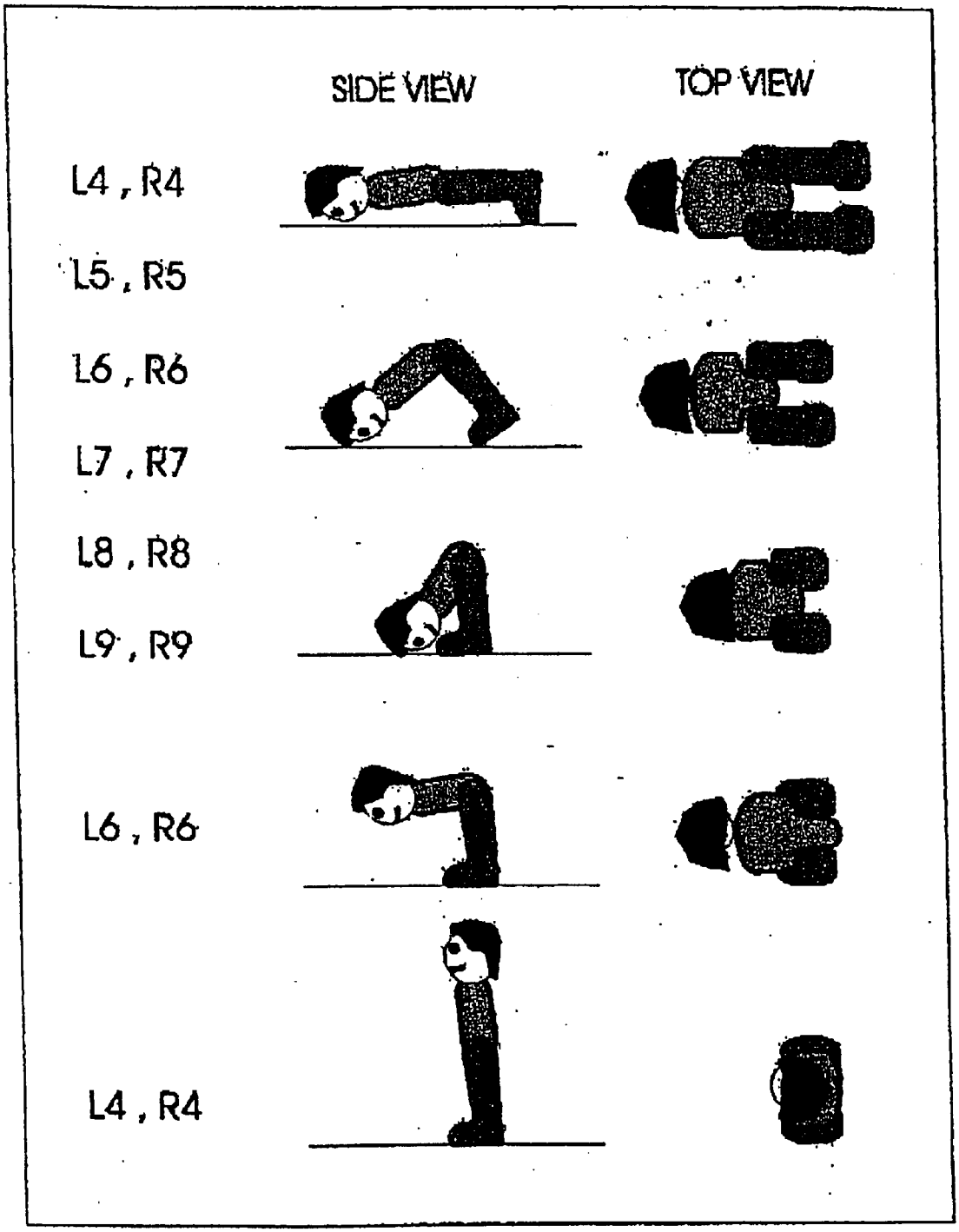
FIG. 10 illustrates the various swipe positions and illustrates the doll in the various positions when moving from its tummy to a standing position.

The moving of the doll 10 from the first orientation to the second orientation is accomplished by pivoting the legs 12 separately to various positions, defined in a set of pre-programmed positions. The positions also correspond to the numerical positions 1–9 defined on the swipe switches 34, referring to FIG. 6. In FIGS. 8–10, the positions are represented by L# and R#, left and right leg respectively, followed by the numerical positions that correspond to the numerical positions on the swipe switches 34. When the doll 10 moves its legs 12 in accordance to the pre-programmed positions, the doll 10 will move from a first orientation to a second orientation. Included therewith are side and top views of the doll 10 during the various positions of the roll.

Following FIG. 8 and FIG. 6, when activated, as mentioned above, the ball switch positions 47, 48, and 49 will indicate to the circuit board 38 the orientation of the doll, which is on its backside 18, as shown in the side and top view of 50*a*. The circuit board 38 will then determine a second orientation to move the doll 10 into and proceed to move the legs 12 in accordance to a set of pre-programmed positions defined to move the doll 10 to the second orientation 50*h*, defined as laying on its tummy 16. For example, starting in the first orientation 50*a*, the legs 12 are both positioned in the L4, R4 position, which corresponds to the $4^{th}$ position on the swipe switch (FIG. 6). In 50*b* the left leg is moved to the L8 position, corresponding to the $8^{th}$ position on the left swipe switch. In 50*c* the right leg is moved to the R1 position and because in this orientation any position below the $4^{th}$ position ($3^{rd}$–$1^{st}$ positions) will push against the surface, causing the doll 10 to rotate or turn onto its side, shown in 50*d*. Following therefrom in 50*e*, the right leg is moved to the R8 position and then the left leg is moved to the L1 position, 50*f*. Since the legs are now in a split position shown in the top view of 50*f* and the left leg is positioned under the right leg, the doll 10 will continue to turn to onto its tummy 16. In 50*g* the legs are moved to the L5, R3 position continuing to turn the doll 10 onto its tummy 16. In the last movement 50*h*, the legs return to the L4, R4 position, which straightens the legs 12 out causing the doll 10 to finish the movement to the second orientation, on its tummy 16. It is important to note that the movements (illustrated in 50*a*–50*h*) defined as a set of pre-programmed positions, may be a single fluid movement of both legs. The circuit board 38 will constantly monitor the swipe switches to detect the positions of each leg such that the motor mechanisms are properly controlled.

Upon completing the roll onto its tummy 16, the ball switch positions 47, 48, and 49 further indicate to the circuit board 38 that the doll 10 is on its tummy 16. This now becomes a first orientation for which the circuit board 38 may determine a second orientation to move the doll 10 into, for example the doll 10 may continue to roll back onto its backside 18. The rolling is similarly accomplished by rotating its legs 12 separately to various pre-programmed positions defined on the swipe switches 34. The positions to move the doll 10 from its tummy 16 to its backside 18 are illustrated in FIG. 9.

Alternatively, when the doll 10 is laying on its tummy 16, the doll 10 may also move to another second orientation defined as a standing position. Referring now to FIG. 10, the various pre-programmed positions for the legs 12 necessary to accomplish this movement are illustrated. Once standing, the foot switch 44 is depressed indicating that the doll is standing as opposed to being in another position or being held by the user. From the standing position the legs 12 may begin to move such that the doll 10 is capable of walking.

The doll 10 may also stand up automatically. When laying on its tummy 16, the ball switch communicates with the circuit board 38 and turns on both motor mechanisms 22 simultaneously. The doll 10 pivots its legs 12 forwards causing the doll 10 to stand up straight. The swipe switch 34, in communication with the circuit board 38, synchronizes this simultaneous action of the motor mechanisms 22. The swipe switches 34 continually check the positions of both legs with respect to each other, making sure that one is not lagging behind.

In addition, the doll 10 may also emit various phrases that are in response to various movements or orientations. For example, since the doll 10 is capable of distinguishing when it is in the standing position from being held, the doll 10 may say, "I LOVE YOU" when held and "WATCH ME WALK" when standing.

From the foregoing and as mentioned above, it will be observed that numerous variations and modifications may be effected without departing from the spirit and scope of the novel concept of the invention, such that other sets of preprogrammed positions (not shown) that moves the doll 10 into other orientations or the same orientations may be employed. It is to be understood that no limitation with respect to the specific methods and apparatus illustrated herein is intended or should be inferred. It is, of course, intended to cover by the appended claims all such modifications as fall within the scope of the claims.

We claim:

1. A doll comprising:

a pair of legs pivotally attached to a torso, said torso having a front side and backside; a pair of motor mechanisms separately attached to each leg for pivoting the legs forwards and backwards in accordance with a set of pre-programmed positions that moves the doll from a first orientation to a second orientation, and an activation switch which when engaged activates the motor mechanisms to move the doll, wherein a pair of multi-positioned swipe switches separately attached to the legs, each swipe switch has a corresponding swipe mechanism attached to the torso and positioned to be in contact with the corresponding swipe switch; and a circuit board in communication with the pair of swipe switches and motor mechanisms such that the circuit board may operate the motor mechanisms and pivot the legs in accordance with the set of pre-programmed positions which further corresponds to specific positions defined by the multi-positioned swipe switches.

2. The doll of claim 1, wherein the set of pre-programmed positions moves the doll from a first orientation defined as laying on the backside to a second orientation defined as laying on the front side.

3. The doll of claim 1, wherein the set of pre-programmed positions moves the doll from a first orientation defined as laying on the front side to a second orientation defined as laying on the backside.

4. The doll of claim 1, wherein the set of pre-programmed positions moves the doll from a first orientation defined as laying on the front side to a second orientation defined as standing.

5. The doll of claim 1, further comprising a means to determine the first orientation of the doll, such that the circuit board may select a second orientation and operate the motor mechanisms in accordance with a set of pre-programmed positions defined to move the doll from said first orientation to said selected second orientation.

6. The doll of claim 5, wherein the determining means includes a plurality of ball switch positions acting in concert with each other to indicate to the circuit board an orientation.

7. The doll of claim 6, wherein the determining means further includes a foot switch, said foot switch indicates to the circuit board that the doll is in a standing orientation on a surface.

8. The doll of claim 1, wherein the pair of motor mechanisms pivots the legs in accordance with a set of pre-programmed positions that walks the doll, when the doll is in a standing orientation.

9. A doll comprising:

a pair legs pivotally attached to a torso, said torso having a front side and backside;

a pair of motor mechanisms separately attached to each leg for pivoting the legs forwards and backwards in accordance to at least one set of pre-programmed positions that moves the doll from a first orientation to a second orientation;

a circuit board in communication with and control of the motor mechanisms; and a means to determine the first orientation of the doll, such that the circuit board may select the second orientation, from a set of second orientations, and operate the motor mechanisms in accordance to a set of pre-programmed positions defined to move the doll from the first orientation to said selected second orientation.

10. The doll of claim 9, wherein one of the sets of pre-programmed positions is defined to move the doll from a first orientation defined as laying on the backside to a second orientation defined as laying on the front side.

11. The doll of claim 9, wherein one of the sets of pre-programmed positions is defined to move the doll from a first orientation defined as laying on the front side to a second orientation defined as laying on the backside.

12. The doll of claim 9, wherein one of the sets of pre-programmed positions is defined to move the doll from a first orientation defined as laying on the front side to a second orientation defined as standing.

13. The doll of claim 12, wherein the determining means further includes a foot switch, said foot switch indicates to the circuit board that the doll is in a standing orientation on a surface.

14. The doll of claim 9, wherein the determining means includes a plurality of ball switch positions acting in concert with each other to indicate to the circuit board an orientation.

15. The doll of claim 9, wherein the pair of motor mechanisms pivots the legs in accordance to a set of pre-programmed positions that walks the doll, when the first orientation is a standing orientation.

16. The doll of claim 9 further comprising:

a pair of multi-positioned swipe switches separately attached to the legs, each swipe switch has a corresponding swipe mechanism attached to the torso and positioned to be in contact with the corresponding swipe switch; and the circuit board in communication with the pair of swipe switches and motor mechanisms such that the circuit board may operate the motor mechanisms and pivot the legs in accordance to a set of pre-programmed positions which corresponds to specific positions defined by the multi-positioned swipe switches.

17. A doll comprising:

a pair legs pivotally attached to a torso, said torso having a front side and backside;

a means to determine a first orientation of the doll;

a means for determining the position of each leg, a motor means for pivoting each leg forwards and backwards; and a circuit board being in communication with the orientation determining means, the leg position determining means and the motor means may select a second orientation, from a set of second orientations, and move each leg in accordance with a set of pre-programmed positions defined to move the doll from said first orientation to said second orientation.

18. The doll of claim 17, wherein the orientation determining means includes: a plurality of ball switch positions acting in concert with each other to indicate to the circuit board orientation, such as but not limited to, laying down on the backside, laying down on the front side and upright, and a foot switch to indicate to the circuit board that the doll is in a standing orientation on a surface.

* * * * *